US010415115B2

(12) United States Patent
Takahashi et al.

(10) Patent No.: US 10,415,115 B2
(45) Date of Patent: Sep. 17, 2019

(54) CONTINUOUS ANNEALING SYSTEM AND CONTINUOUS ANNEALING METHOD

(71) Applicant: JFE STEEL CORPORATION, Tokyo (JP)

(72) Inventors: Hideyuki Takahashi, Fukuyama (JP); Nobuyuki Sato, Jakarta (ID); Hiroyuki Yokoyama, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 599 days.

(21) Appl. No.: 15/034,340

(22) PCT Filed: Oct. 30, 2014

(86) PCT No.: PCT/JP2014/005521

§ 371 (c)(1),
(2) Date: May 4, 2016

(87) PCT Pub. No.: WO2015/068369

PCT Pub. Date: May 14, 2015

(65) Prior Publication Data

US 2016/0265079 A1 Sep. 15, 2016

(30) Foreign Application Priority Data

Nov. 7, 2013 (JP) ..... 2013-231112

(51) Int. Cl.
*C21D 9/573* (2006.01)
*C22C 38/04* (2006.01)
(Continued)

(52) U.S. Cl.
CPC ..... *C21D 9/561* (2013.01); *C21D 1/26* (2013.01); *C21D 1/767* (2013.01); *C21D 9/56* (2013.01);
(Continued)

(58) Field of Classification Search
CPC ..... C21D 9/561; C21D 9/52
See application file for complete search history.

(56) References Cited

U.S. PATENT DOCUMENTS

2013/0273251 A1* 10/2013 Takahashi ..... C21D 1/74 427/321
2015/0159235 A1* 6/2015 Takahashi ..... C21D 1/76 148/533
2016/0265079 A1* 9/2016 Takahashi ..... C21D 9/56

FOREIGN PATENT DOCUMENTS

EP 2653572 A1 10/2013
JP H02-236229 A 9/1990
(Continued)

OTHER PUBLICATIONS

Oct. 17, 2016 Extended European Search Report issued in European Patent Application No. 14860452.3.
(Continued)

*Primary Examiner* — Scott R Kastler
(74) *Attorney, Agent, or Firm* — Oliff PLC

(57) ABSTRACT

A continuous annealing system and a continuous annealing method with which it is possible to achieve an annealing atmosphere having a low dew point which is suitable for annealing a steel strip containing easily oxidizable metals such as Si and Mn at low cost and with stability by preventing easily oxidizable metals such as Si and Mn in steel from being concentrated in a surface portion of a steel strip and preventing the formation of oxides of easily oxidizable metals such as Si and Mn.

22 Claims, 4 Drawing Sheets

(51) Int. Cl.

| | |
|---|---|
| ***C21D 9/56*** | (2006.01) |
| ***C21D 1/26*** | (2006.01) |
| ***C21D 1/767*** | (2006.01) |
| *C21D 1/74* | (2006.01) |
| *C21D 1/76* | (2006.01) |
| *C21D 6/00* | (2006.01) |

(52) U.S. Cl.
CPC ..... *C21D 9/562* (2013.01); *C21D 1/74* (2013.01); *C21D 1/76* (2013.01); *C21D 6/005* (2013.01); *C21D 6/008* (2013.01)

(56) References Cited

FOREIGN PATENT DOCUMENTS

| | | | |
|---|---|---|---|
| JP | H07-18340 | A | 1/1995 |
| JP | 2567130 | B2 | 12/1996 |
| JP | 2567140 | B2 | 12/1996 |
| JP | H09-256074 | A | 9/1997 |
| JP | H09-324210 | A | 12/1997 |
| JP | 2000-290762 | A | 10/2000 |
| JP | 2002-003853 | A | 1/2002 |
| JP | 2002-003953 | A | 1/2002 |
| JP | 2013-185159 | A | 9/2013 |
| KR | 2013-0109192 | A | 10/2013 |
| WO | 2007/043273 | A1 | 4/2007 |
| WO | 2013/108624 | A1 | 7/2013 |
| WO | 2013/150710 | A1 | 10/2013 |
| WO | 2013/187039 | A1 | 12/2013 |
| WO | 2013/187042 | A1 | 12/2013 |

OTHER PUBLICATIONS

Jan. 27, 2015 International Search Report issued in International Application No. PCT/JP2014/005521.
Jul. 19, 2018 Notice of Allowance issued in Korean Patent Application No. 10-2016-7014730.
Dec. 14, 2016 Office Action in Chinese Patent Application No. 201480060942.7.
Feb. 22, 2018 Office Action issued in Korean Patent Application No. 10-2016-7014730.

* cited by examiner

CONTINUOUS ANNEALING SYSTEM AND CONTINUOUS ANNEALING METHOD

This application is a national stage of PCT/JP2014/005521, filed Oct. 30, 2014, which claims the benefit of priority to Japanese Application No. 2013-231112, filed Nov. 7, 2013. The entire contents of the prior applications are hereby incorporated by reference herein in their entirety.

TECHNICAL FIELD

This application relates to a continuous annealing system and a continuous annealing method.

BACKGROUND

Nowadays, in the fields of, for example, automobile, domestic electric appliance, and building material industries, there is an increasing demand for a high-strength steel strip (high tensile strength steel strip) capable of contributing to, for example, the weight reduction of structures. In the case of a technique using this high tensile strength steel strip, it may be possible to manufacture a high-strength steel strip having good stretch flange formability by adding Si in steel. In addition, in the case of a technique using this high tensile strength steel strip, it may be possible to provide a high-strength steel strip having good ductility due to a tendency for a retained γ phase to be formed by adding Si and Al in steel.

However, in the case of a high-strength cold-rolled steel strip containing easily oxidizable metals such as Si and Mn, there is a problem in that these easily oxidizable metals are concentrated in a surface portion of the steel strip when annealing is performed and oxides of, for example, Si and Mn are formed, which results in surface appearance defects or defects in a chemical conversion treatment such as a phosphating treatment.

In addition, in the case of a galvanized steel strip containing easily oxidizable metals such as Si and Mn, there is a problem in that these easily oxidizable metals are concentrated in a surface portion of the steel strip when annealing is performed and oxides of, for example, Si and Mn are formed, which results in nonplating defects due to a decrease in zinc coatability or results in a decrease in alloying speed when an alloying treatment is performed after a coating treatment has been performed.

In particular, in the case where Si is contained and an oxide film of $SiO_2$ is formed on the surface of a steel strip, there is a significant decrease in wettability between the steel strip and a molten coating metal. In addition, the oxide film of $SiO_2$ functions as a barrier to diffusion between the base steel and a coating metal when an alloying treatment is performed, which results, in particular, in a problem of a decrease in zinc coatability and alloying treatment performance.

As an example of a method for avoiding these problems, consideration is given to a method for controlling the oxygen potential in an annealing atmosphere.

Patent Literature 1 discloses an example of a method for increasing the oxygen potential in which the dew point is controlled to be high, that is, −30° C. or higher from a rear heating zone to a soaking zone. This method can be expected to be effective to some extent and has an advantage in that the dew point can be controlled to be high easily in an industrial manner.

However, this method has a disadvantage in that, with this method, it is not easy to manufacture some steel grades (such as Ti-based IF (Interstitial Free) steel) for which an operation in an atmosphere having a high dew point is not desirable. This is because it takes a very long time to control the dew point of an annealing atmosphere to be low once the dew point has been controlled to be high. In addition, since an oxidizing furnace atmosphere is used in this method, there may be a problem of pickup defects due to oxides sticking to rolls in the furnace and of furnace wall damage in the case where there is a control error.

As another example, consideration is given to controlling the oxygen potential to be low.

However, in the case of a large-scale continuous annealing furnace which is used in a CGL (continuous galvanizing line) or a CAL (continuous annealing line), since Si and Mn are very easily oxidized, it is very difficult to stably control the dew point of the furnace atmosphere to be low, that is, −40° C. or lower where there is a good effect for suppressing oxidation of, for example, Si and Mn.

Although Patent Literature 2 and Patent Literature 3 disclose techniques with which an annealing atmosphere having a low dew point can be efficiently achieved, since these techniques are intended for comparatively small-scale furnaces of a one-pass vertical type, no consideration is given to annealing a steel strip containing easily oxidizable metals such as Si and Mn by using an annealing furnace of a multipass vertical type such as a CGL or a CAL.

CITATION LIST

Patent Literature

PTL 1: International Publication No. 2007/043273
PTL 2: Japanese Patent No. 2567140
PTL 3: Japanese Patent No. 2567130

SUMMARY

Technical Problem

The disclosed embodiments have been completed in view of the situation described above, and aims to provide a continuous annealing system and a continuous annealing method with which it is possible to achieve an annealing atmosphere having a low dew point which is suitable for annealing a steel strip containing easily oxidizable metals such as Si and Mn at low cost and with stability by preventing easily oxidizable metals such as Si and Mn in steel from being concentrated in a surface portion of a steel strip and the formation of oxides of easily oxidizable metals such as Si and Mn.

Solution to Problem

It is necessary to identify the generation source of water in order to efficiently achieving a low dew point in a large-scale annealing furnace. As a result of diligently conducted investigations, it was found that a large amount of water is desorbed even from a steel strip which has been sufficiently pickled and dried. From the results of close investigations regarding a temperature range in which water is desorbed, as illustrated in FIG. 5, it was found that most of the water is desorbed in a temperature range of 200° C. to 400° C. and that almost all of the water is desorbed in a temperature range of 150° C. to 600° C.

Here, in experiments conducted in the above close investigations regarding a temperature range in which water is desorbed, as illustrated in FIG. 6, ten steel sheets 92 (having a size of 100 mm×200 mm and a thickness of 1.0 mm) having the same chemical composition as that of the cold-rolled steel strip given in Table 1 below were put in an infrared heating furnace 9 (having a furnace volume of 0.016 $m^3$) and heated at a heating rate of 1° C./sec in order to observe a change in dew point by using a mirror surface type dew point meter 91. Here, a gas having a dew point of −60° C. was supplied at a flow rate of 1 $Nm^3$/hr while heating is performed in order to determine the dew point of the exhaust gas.

On the other hand, from the results of a lab-scale coating test, it was also found that easily oxidizable metals such as Si and Mn are oxidized and concentrated in a surface portion of a steel strip (which decreases zinc coatability and causing, for example, nonplating defects) at a temperature of 700° C. or higher. From these findings, it is clarified that a temperature range in which water is desorbed and a temperature range in which a low dew point is needed are different from each other. Therefore, if it is possible to substantively separate atmospheres based on temperature at a temperature of, for example, about 600° C., it is possible to achieve a low dew point in a temperature range of 700° C. or higher in which surface concentration has a negative effect.

Moreover, without intending to be bound by theory, it was believed that by using a numerical analysis, it is possible to realize such atmosphere separation by using an easy and low-cost method in which air is blown onto a down-pass steel strip in a furnace in a direction almost parallel to the surface of the steel strip, and verified the prediction by building practical equipment.

The disclosed embodiments have been completed on the basis of the findings described above and specifically is as follows.

[1] A continuous annealing system including a vertical annealing furnace having upper rolls and lower rolls on which a steel strip is wound, a heating zone, and a soaking zone; gas suction ports through which a part of a gas inside the vertical annealing furnace is suctioned; a refiner in which water and oxygen are removed from the gas suctioned through the gas suction ports; and gas delivery ports through which the gas treated in the refiner is returned to the vertical annealing furnace, in which the gas delivery ports are provided at positions where the gas is blown to a steel strip descending in a temperature range of 300° C. or higher and 700° C. or lower in the vertical annealing furnace.

[2] The continuous annealing system according to item [1] described above, in which one or more of the gas delivery ports are placed at a position expressed by the relational expression below:

$$L \geq 0.7 \times L_0,$$

where L is distance from the center of a lower roll to a delivery port and $L_0$ is distance between the centers of an upper roll and a lower roll on which the steel strip travels next to the upper roll.

[3] The continuous annealing system according to item [1] or [2] described above, in which one or more of the gas delivery ports are placed on a furnace side wall so that the gas is blown in a direction at an angle of −30° or more and 10° or less (where + indicates an upward direction and − indicates a downward direction) to the horizontal direction.

[4] The continuous annealing system according to any one of items [1] to [3] described above, in which the gas is blown from the same side wall direction through all the gas delivery ports.

[5] The continuous annealing system according to any one of items [1] to [4], in which the vertical annealing furnace further includes a first flow-straightening plate, a second flow-straightening plate, and a third flow-straightening plate, in which the first flow-straightening plate is a convex body extending from the bottom of the vertical annealing furnace and facing the lower roll on which a steel strip located in the direction in which the gas is blown from the gas delivery port or in the vicinity of the direction is wound first after the gas has been blown, in which the second flow-straightening plate and the third flow-straightening plate are convex bodies extending from side walls of the vertical annealing furnace facing each other at positions immediately before the position where the steel strip is wound on the lower roll, in which the distance between the lower roll and the first flow-straightening plate is 40 mm or more and 200 mm or less, and in which the second flow-straightening plate and the third flow-straightening plate have a length of 200 mm or more and ((Wf−Ws)/2−50) mm or less in the width direction of the steel strip and a length of 100 mm or more and (Px−300) mm or less in the traveling direction of the steel strip, where Wf is furnace width, Ws is width of the steel strip, and Px is distance between the furnace top and the top surface of the lower roll.

[6] A continuous annealing method including continuously annealing a steel strip by using a vertical annealing furnace having upper rolls and lower rolls on which a steel strip is wound, a heating zone, and a soaking zone, in which gas suction ports through which a part of a gas inside the vertical annealing furnace is suctioned, a refiner in which water and oxygen are removed from the gas suctioned through the gas suction ports, and gas delivery ports through which the gas treated in the refiner is returned to the vertical annealing furnace are provided and in which the gas delivery ports are provided at positions where the gas is blown onto a steel strip descending in a temperature range of 300° C. or higher and 700° C. or lower in the vertical annealing furnace.

[7] The continuous annealing method according to item [6] described above, in which one or more of the gas delivery ports are placed at a position expressed by the relational expression below:

$$L \geq 0.7 \times L_0,$$

where L is distance from the center of a lower roll to a delivery port and $L_0$ is distance between the centers of an upper roll and a lower roll on which the steel strip travels next to the upper roll.

[8] The continuous annealing method according to item [6] or [7] described above, in which one or more of the gas delivery ports are placed on a furnace side wall so that gas is blown in a direction at an angle of −30° or more and 10° or less (where + indicates an upward direction and − indicates a downward direction) to the horizontal direction.

[9] The continuous annealing method according to any one of items [6] to [8] described above, in which the gas is blown from the same side wall direction through all the gas delivery ports.

[10] The continuous annealing method according to any one of items [6] to [9], in which the vertical annealing furnace further includes a first flow-straightening plate, a second flow-straightening plate, and a third flow-straightening plate, in which the first flow-straightening plate is a convex body extending from the bottom of the vertical annealing furnace and facing the lower roll on which a steel strip located in the direction in which the gas is blown from the gas delivery port or in the vicinity of the direction is wound first after the gas has been blown, in which the second flow-straightening plate and the third flow-straightening plate are convex bodies extending from side walls of the vertical annealing furnace facing each other at positions immediately before the position where the steel strip is wound on the lower roll, in which the distance between the lower roll and the first flow-straightening plate is 40 mm or more and 200 mm or less, and in which the second flow-straightening plate and the third flow-straightening plate have a length of 200 mm or more and ((Wf−Ws)/2−50) mm or less in the width direction of the steel strip and a length of 100 mm or more and (Px−300) mm or less in the traveling direction of the steel strip, where Wf is furnace width, Ws is width of the steel strip, and Px is distance between the furnace top and the top surface of the lower roll.

Advantageous Effects

In embodiments, it is possible to achieve an annealing atmosphere having a low dew point which is suitable for annealing a steel strip containing easily oxidizable metals such as Si and Mn at low cost and with stability by preventing easily oxidizable metals such as Si and Mn in steel from being concentrated in a surface portion of a steel strip and the formation of oxides of easily oxidizable metals such as Si and Mn.

That is, according to embodiments, it is possible to achieve an annealing atmosphere having a low dew point which is suitable for annealing a steel strip containing easily oxidizable metals such as Si and Mn at low cost, and it is possible to increase zinc coatability when a galvanizing treatment is performed on a steel strip containing easily oxidizable metals such as Si and Mn.

In addition, by using the continuous annealing system according to embodiments, since the surface concentration of easily oxidizable metals such as Si and Mn is suppressed, the annealed steel strip has an increased alloying treatment performance, a surface appearance in which defects are less likely to occur, and an excellent chemical conversion treatment performance.

DETAILED DESCRIPTION

Disclosed embodiments will be described.

As described above, regarding water which is desorbed from a steel strip, most of the water is desorbed at a temperature of 200° C. to 400° C., and almost all of the water is desorbed at a temperature of 150° C. to 600° C. This is caused by the reduction reaction of a natural oxidation film which is inevitably formed mainly on the surface of a steel strip. Although this natural oxidation film has a thickness of about 10 nm, this natural oxidation film desorbs a sufficient amount of water to increase the dew point of the furnace interior. For example, in the case where a steel strip having a width of 1.25 m passes through a furnace at a line speed (LS) of 90 mpm, the amount of water desorbed by a reduction reaction per unit hour is 12.1 mol/hr or 0.272 $Nm^3$/hr in terms of water vapor volume. This value corresponds to the amount of water to increase the average dew point of the furnace interior to about −32° C. in the case where the flow rate of a supplied furnace gas (having a dew point of −60° C.) is 1000 $Nm^3$/hr.

On the other hand, the surface concentration of easily oxidizable metals, which decreases zinc coatability, has a negative effect at a temperature of 700° C. or higher in the case of Si-based metals, or 800° C. or higher in the case of Mn-based metals. Therefore, since a temperature range in which a reduction reaction progresses (a temperature range in which water is desorbed) and a temperature range in which surface concentration progresses (a temperature range in which a low dew point is needed) do not overlap with each other, it is possible to separate the temperature ranges, and it is very difficult to decrease the dew point in a temperature range in which surface concentration progresses in the case where atmospheres are not separated. The easiest method for separating atmospheres is to provide a physical barrier, that is, to provide a dividing wall which separates atmospheres. However, in the case of an existing system, since additional construction of dividing walls is needed, it is necessary to stop the system for a long time. Therefore, it is practical to select gas separation instead of physical separation.

Hereafter, a continuous annealing system according to an embodiment will be described in detail with reference to the drawings.

Figure 1:
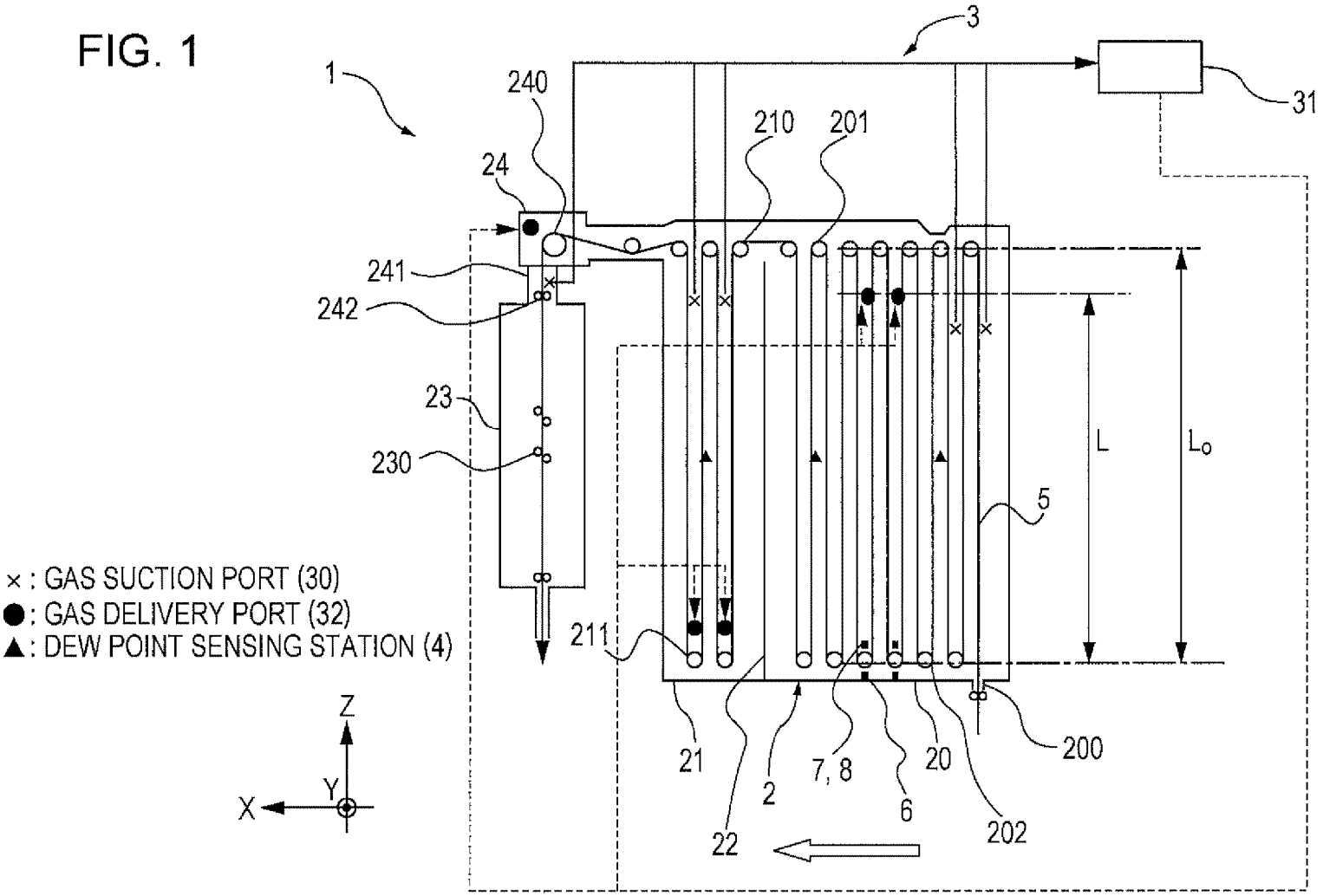
FIG. 1 is a schematic diagram illustrating a continuous annealing system according to an embodiment.

FIG. 1 is a schematic diagram illustrating a continuous annealing system according to an embodiment. A continuous annealing system 1 according to the embodiment is a system which includes a vertical annealing furnace 2, an oxygen-water-removing unit 3, and dew point sensing stations 4 and in which a steel strip 5 is annealed.

The vertical annealing furnace 2 has a heating zone 20, a soaking zone 21, a dividing wall 22, a cooling zone 23, and a connecting section 24. The heating zone 20 and the soaking zone 21 communicate with each other in the upper part of the furnace (vertical annealing furnace 2). With the exception of a communicating plate in the upper part of the furnace, the dividing wall 22, which separates the atmospheric gases of the heating zone 20 and the soaking zone 21, is placed. In addition, the soaking zone 21 and the cooling zone 23 communicate with each other through the connecting section 24. Here, the steel strip 5 travels through the heating zone 20, the soaking zone 21, and the cooling zone 23 in this order.

The heating zone 20 has an open mouth 200, plural upper rolls 201, and plural lower rolls 202. The steel strip 5 enters the heating zone 20 through the open mouth 200 and ascends toward an upper roll 201. Subsequently, the steel strip 5 changes its traveling direction by traveling on the upper roll 201 and descends toward a lower roll 202. Subsequently, the steel strip 5 changes its traveling direction by traveling on the lower roll 202 and ascends toward the next upper roll 201. By repeating the traveling in such a manner, the steel strip 5 is transported in the direction of the white outlined arrow while the steel strip 5 ascends and descends.

Although there is no particular limitation on what means is used for heating the traveling steel strip 5 in the heating zone, a radiant tube method is generally selected in many cases from the viewpoint of, for example, heating costs. Although it is possible to perform heating at low cost by using, for example, a burner method, since a combustion gas is emitted into the atmosphere, this method is completely unsuitable for the case where atmosphere control is needed as is the case with the present embodiment. In addition, although there is no such problem in the case of an electric heating method (including an induction heating method), there is a significant increase in heating costs.

By defining one pass as one in which the steel strip 5 enters through the open mouth 200 and ascends to the first upper roll 201, one in which the steel strip 5 descends from the upper roll 201 to the next lower roll 202, or one in which the steel strip 5 ascends from the lower roll 202 to the next upper roll 201, the steel strip 5 travels through 13 passes in the heating zone 20 in the present embodiment.

The soaking zone 21, like the heating zone 20, has plural upper rolls 210 and plural lower rolls 211. As described above, the soaking zone 21 and the heating zone 20 are connected with each other in the upper part of the furnace. In this connecting part, the steel strip 5 travels from the upper roll 201 located at the farthest downstream position in the heating zone 20 to the upper roll 210 located at the farthest upstream position in the soaking zone 21. The steel strip 5 which has reached the upper roll 210 located at the farthest upstream position in the soaking zone 21 descends towards the lower roll 211 and then travels alternately on an upper roll 210 and a lower roll 211. In such a manner, the steel strip 5 is transported in the direction of the white outlined arrow while the steel strip 5 ascends and descends. Although there is no particular limitation on what method is used for heating the steel strip 5 in the soaking zone 21, it is preferable to use radiant tubes (RT). Here, by defining one pass in the soaking zone 21 as in the heating zone 20, the steel strip 5 travels through 4 passes.

The dividing wall 22 is placed in the middle position, in the longitudinal direction of the furnace, between the upper roll 201 at the exit of the heating zone 20 and the upper roll 210 at the entrance of the soaking zone 21 so that the upper end of the dividing wall 22 is adjacent to the traveling steel strip 5, the lower end and the side ends in the width direction of the steel strip are fitted to the furnace walls, and thus the dividing wall 22 vertically stands.

The steel strip 5 which has been transported from the soaking zone 21 is cooled in the cooling zone 23. The top end of the cooling zone 23 is connected to the top end on the downstream side of the soaking zone 21 through the connecting section 24. Although the steel strip 5 may be cooled by using any kind of cooling method in this cooling zone 23, the cooling zone 23 in the present embodiment has a long shape and guide rolls 230 so that the steel strip 5 descending through the guide rolls 230 is cooled by using a cooling means.

The connecting section 24 is placed in the upper part of the furnace on the top of the cooling zone 23 and has a roll 240, a throat 241, and seal rolls 242. The roll 240 changes the traveling direction of the steel strip 5, which has been transported from the soaking zone 21, to a downward direction. The throat 241 (a part having a structure in which the area of a cross section through which the steel strip travels is decreased) and the seal rolls 242 suppress the atmosphere in the soaking zone 21 flowing into the cooling zone 23.

The oxygen-water-removing unit 3 has gas suction ports 30 through which a part of the gas (atmospheric gas) in the vertical annealing furnace 2 is suctioned, a refiner 31 in which water and oxygen are removed from the gas which has been suctioned through the gas suction ports 30, and gas delivery ports 32 through which the gas which has been treated in the refiner 31 is returned to the vertical annealing furnace 2.

A part of the gas in the vertical annealing furnace 2 is suctioned through the gas suction ports 30. Although there is no particular limitation on the positions where the gas suction ports 30 are provided, the positions of the gas suction ports 30 in the present embodiment are decided, for example, from the following viewpoint.

Although it is preferable that the gas suction ports 30 be placed at positions where the dew point of the atmosphere is high because it is possible to efficiently remove water, since most of the water which is desorbed from the steel strip 5 is desorbed in a temperature range of 200° C. to 400° C., it is considered that it is preferable that the gas suction ports 30 be provided on the upstream side in the heating zone 20. Here, "upstream side" refers to a region almost corresponding to the 2nd to 6th passes in the case of a heating zone having about 13 passes, for example, as is the case with the present embodiment. Moreover, from the results of the multipoint measurement of the dew point of the furnace interior, it was found that the dew point is higher in the upper part of the furnace than in the lower part of the furnace. Therefore, the gas suction ports 30 are provided in the upper part of the furnace on the upstream side in the heating zone in the present embodiment.

Surface concentration has a negative effect at a temperature of 700° C. or higher in the case of Si-based metals, or 800° C. or higher in the case of Mn-based metals. Therefore, it is also preferable that the dew point of the soaking zone 21 be low. Therefore, it is also preferable that the gas suction ports 30 be provided in the soaking zone 21. Here, the gas suction ports 30 may also be provided in the latter part (on the downstream side) in the heating zone 20.

It is preferable that the gas suction ports 30 be placed on the upstream side of the gas delivery ports 32 within the whole heating zone 20. This is because it is possible to avoid obstruction to the flow of the atmospheric gas which is fed into the vertical annealing furnace 2 from the outside of furnace, flows through the cooling zone 23, the soaking zone 21, and the heating zone 20 in this order, and is discharged through the open mouth 200 of the heating zone 20. It is preferable to avoid obstruction to the flow of the atmospheric gas because, for example, external gases are less likely to flow in through the open mouth 200 when the flow of the atmospheric gas is not obstructed. "Placed on the upstream side of" means that some of the gas suction ports 30 may be placed on the downstream side of the gas delivery ports 32 as long as the flow of the atmospheric gas is not obstructed.

In addition, although there is no particular limitation on the number of the gas suction ports 30 in the heating zone 20, it is preferable to provide plural gas suction ports, because it is necessary to increase the bore diameter of the suction port in order to avoid pressure loss in the case where the gas is suctioned by using one suction port, which results in negative effects on construction conditions and equipment costs.

Here, there is no particular limitation on the amount of gas suctioned through each gas suction port 30, and the amount of gas suctioned may be appropriately controlled based on, for example, the detection results at the dew point sensing stations 4. Although there is no particular limitation on the flow rate of gas suction, the flow rate of gas suction with respect to the area of a suction cross section may be appropriately set so that pressure loss is not excessively large, because there is an increase in flow velocity in the case where there is an increase in the flow rate of gas suction, which results in negative effects due to an increase in pressure loss.

Since a gas having a high dew point flows into the upper part of the cooling zone 23 from a galvanizing pot (not illustrated) side, which is placed downstream of the cooling zone 23, it is preferable to place a gas suction port 30 in the lower part of the connecting section 24. In addition, it is particularly preferable to place the gas suction port 30 at a position, for example, in the vicinity of the throat 241 or in the vicinity of the seal rolls 242 located in the lower part of the connecting section 24 where the flow channel is narrow. However, it is preferable to place the gas suction port 30 within 4 m, or more preferably within 2 m, from the cooling means in the cooling zone 23. This is because, since it is possible to avoid the steel strip being exposed to a gas having a high dew point for a long time before the start of cooling in the case where the distance from the cooling means is small, there is no concern that easily oxidizable metals such as Si and Mn may be concentrated in a surface portion of the steel strip.

Water and oxygen are removed from the gas which has been suctioned through the gas suction ports 30 in the refiner 31. There is no particular limitation on the specific configuration of the refiner 31, a refiner 31 having a heat exchanger, a cooler, a filter, a blower, a deoxidation device, and a dehumidification device may be used. In the case of this refiner 31, by suctioning the atmospheric gas through the gas suction ports 30 by using a blower, by cooling the atmospheric gas to a temperature of about 40° C. or lower by passing the suctioned gas through the heat exchanger and the cooler in this order, by cleaning the gas by using a filter, by deoxidizing the atmospheric gas by using the deoxidation device, and by dehumidifying the atmospheric gas by using the dehumidification device, it is possible to decrease the dew point to about −60° C. It is possible to return the gas having the decreased dew point to the furnace interior through the gas delivery ports 32 after passing the gas through the heat exchanger.

The gas treated in the refiner 31 is returned to the vertical annealing furnace 2 through the gas delivery ports 32. The present embodiment is characterized by the positions where the gas delivery ports 32 are provided as specifically described hereafter.

By blowing the gas onto the descending steel strip 5 through the gas delivery port 32, the mixing of the furnace atmosphere on the downstream side of the gas delivery port 32 and the furnace atmosphere on the upstream side thereof is suppressed.

In the present embodiment, plural gas delivery ports 32 are provided on different descending passes (down passes). The reason why plural gas delivery ports are placed on different passes is because there is an increase in equipment costs since it is necessary to increase the bore diameter of the port in order to avoid an increase in pressure loss in the case of a single gas delivery port 32 and because the effect of separating the atmospheres is increased since a multiple-shield effect is realized in the case where plural gas delivery ports 32 are placed on different passes.

However, in the case where plural gas delivery ports 32 are provided on one pass, although it is not possible to realize a multiple-shield effect, there is less increase in equipment costs than in the case where a single gas delivery port is placed on one pass, and the effect of separating the atmospheres is efficiently realized in some cases. For example, if the gas is blown in the middle position by using the same structure, it is possible to separate a considerably long distance. Specifically, for example, in the case where the atmospheres of an annealing furnace having a furnace height of about 30 m are separated, it is possible to efficiently separate the atmospheres by placing a gas delivery port in the middle position of the furnace height (for example, at a height of 12 m) in addition to one in the upper part of the furnace (for example, at a height of about 25 m) and blowing the gas.

In addition, the positions where the gas delivery ports 32 are provided are in a region in which the temperature of the steel strip in the vertical annealing furnace 2 is 300° C. or higher and 700° C. or lower. In the case where the gas is delivered at a position where the temperature of the steel strip is 300° C. or higher, since most of water is desorbed before the temperature of the steel strip reaches 300° C., it is possible to inhibit water from flowing into a high-temperature region where it is necessary to decrease the dew point, which is advantageous for decreasing the dew point. In addition, it is preferable that the gas delivery port 32 be placed in the region where the temperature of the steel strip is 700° C. or lower, because a region in which water is desorbed is not included in a region in which a low dew point is needed.

Moreover, although delivering the gas at a temperature of 300° C. or higher is effective for decreasing the dew point, it is strongly recommended that the atmospheres be separated at a temperature higher than 400° C. at which water desorbing has been almost finished. This is because, since desorbed water is scattered across the whole furnace interior in the case where the gas is delivered at a temperature of 400° C. or lower at which water is desorbed, there is a decrease in the effect of decreasing the dew point.

Therefore, it is more preferable that the positions where the gas delivery ports 32 are provided be in a region in which the temperature of the steel strip is higher than 400° C. and 700° C. or lower.

However, since the thermal history of a steel strip varies in accordance with operation conditions such as thickness, LS, and target annealing temperature, it is preferable to allow a margin of about 100° C. in order to adjust for many operation conditions.

Therefore, it is highly preferable that the positions where the gas delivery ports 32 are provided be in a region in which the temperature of the steel strip is 500° C. or higher and 600° C. or lower. The lower limit, that is, 500° C. is derived by adding 100° C. to the above-described preferable lower limit, that is, 400° C., and the upper limit, that is, 600° C. is derived by subtracting 100° C. from the above-described preferable upper limit, that is, 700° C.

As described above, in the present embodiment, the positions where the gas delivery ports 32 are provided are positions (down passes) where it is possible to blow the gas onto the descending steel strip having a temperature in a temperature range of 300° C. or higher and 700° C. or lower in the vertical annealing furnace 2. Specifically, the gas delivery ports 32 are placed on the 6th pass and the 8th pass, which are down passes. The reason why the gas delivery ports 32 are placed on the 6th and 8th passes, which are down passes, instead of 5th and 7th passes, which are up passes, is because, since the delivered gas flows downward, the flow is enhanced by a downward flow accompanying the traveling of the steel strip on the down pass (flow accompanying the steel strip), which results in an increase in the efficiency of separating the atmospheres in the lower part of the furnace.

In addition, it is preferable that the positions where the gas delivery ports 32 are provided be in the upper part of the heating zone 20. This is because of the following reasons. That is, since the temperature of the gas delivered through the gas delivery ports 32 is lower than that of the atmosphere in the furnace, the density of the delivered gas is high. In addition, since a gas delivery ports 32 is generally placed in the lower part of the furnace in many cases, the gas blown into the furnace tends to form a downward flow. Therefore, the best method for realizing a gas seal effect for a long distance is to utilize and enhance this downward flow. Therefore, the higher the position in the furnace where the gas is delivered, the higher the efficiency with which the gas is carried from the upper part of the furnace to the lower part of the furnace and the larger the atmosphere separation effect.

Specifically, when the distance from the upper roll 201 to the next lower roll 202 (the length of one pass, defined as the distance between the center of the upper roll 201 and the center of the lower roll 202) is defined as $L_0$, it is preferable that the distance L from the center of the lower roll 202 (the first lower roll on which the steel strip 5 onto which the gas has been blown is wound) to the gas delivery ports 32 satisfy the relationship $L \geq 0.7 \times L_0$.

It is desirable that the delivered gas is blown in a direction at an angle of −30° or more and 10° or less (where + indicates an upward direction and − indicates a downward direction) to the horizontal direction. In the case where the angle is −30° or more, since the delivered flow impinges on the opposite wall and then dispersedly flows from the wall surface, the effect of separating the atmospheres is sufficiently realized due to the formation of a uniform gas curtain. In addition, in the case where the angle is 10° or less, since there is a decrease in the amount of gas flowing upward after the impingement, a curtain downward in the furnace is sufficiently formed.

In addition, although there is no particular limitation on the distance between the gas delivery port 32 and the gas suction port 30, it is preferable that there be some distance between them, because, since it is possible to suppress the suction, through the gas suction port 30, of the gas having a low dew point which has been delivered through the gas delivery port 32, there is an increase in the proportion of the gas having a high dew point suctioned through the gas suction port 30, which results in an increase in water-removing efficiency. Therefore, it is preferable that the distance between the gas delivery port 32 and the gas suction port 30 be 2 m or more.

Moreover, it is preferable that the delivered gas be blown from the same side wall direction. This is because, since the delivered gas forms a wall jet after having impinged on the opposite side wall, the wall jet and the delivered gas which has just been blown from the opposite wall direction interfere with each other in the case where the delivered gas is blown from the opposite wall direction, which makes it difficult to efficiently form a curtain.

In the case where the gas suction port 30 is placed in the lower part of the connecting section 24, since the furnace pressure may become negative pressure in the vicinity of the gas suction port 30, it is preferable that the gas delivery port 32 be placed in the connecting section 24. It is preferable that the gas delivery port 32 be placed at a position higher than the pass line of the connecting section 24, or more preferably higher than the pass line and on the furnace wall side on the exit side of the furnace downstream of the roll 240 which changes the traveling direction, into downward, of the steel strip which has been transported from the soaking zone.

Here, there is no particular limitation on the amount of gas delivered from one gas delivery port 32, the amount may be appropriately controlled based on, for example, the detection results at the dew point sensing stations 4.

Figure 2:
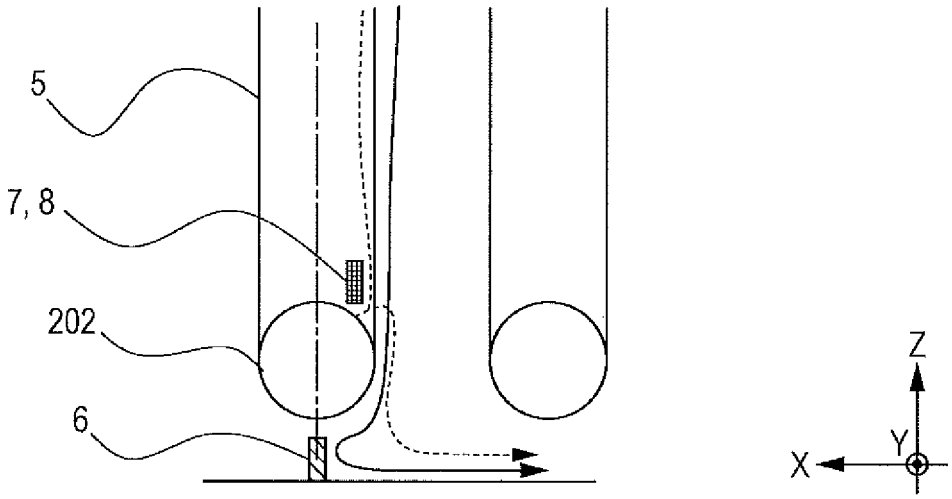
FIG. 2 is an enlarged view of a part in FIG. 1 including a first flow-straightening plate, a second flow-straightening plate, and a third flow-straightening plate.
Figure 3:
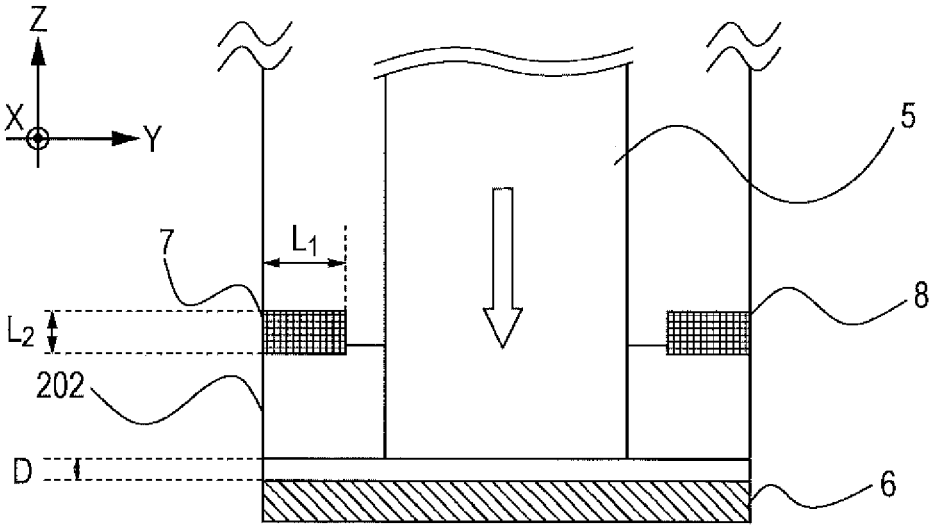
FIG. 3 is a schematic diagram illustrating the first flow-straightening plate, the second flow-straightening plate, and the third flow-straightening plate viewed from the traveling direction of a steel strip (the direction of the white outlined arrow in FIG. 1).

It is preferable that the continuous annealing system 1 according to the present embodiment further include a flow-straightening mechanism (a first flow-straightening plate 6, a second flow-straightening plate 7, and a third flow-straightening plate 8) as illustrated in FIG. 1. FIG. 2 is an enlarged view of a part in FIG. 1 including the first flow-straightening plate 6, the second flow-straightening plate 7, and the third flow-straightening plate 8. FIG. 3 is a schematic diagram illustrating the first flow-straightening plate 6, the second flow-straightening plate 7, and the third flow-straightening plate 8 viewed from the traveling direction of a steel strip 5 (the direction of the white outlined arrow in FIG. 1). Here, in FIG. 2, the solid arrowed line indicates the flow of the gas which flows on the surface on the upstream side of the steel strip 5 and the dotted arrowed line indicates the flow of the gas on the surface on the downstream side of the steel strip 5. In addition, the white outlined arrow in FIG. 3 indicates the traveling direction of the steel strip 5.

The first flow-straightening plate 6 is a convex body extending from the bottom of the vertical annealing furnace 2 and facing a lower roll 202 on which a steel strip 5 located in the direction in which the gas is blown from the gas delivery port 32 or in the vicinity of the direction is wound first after the gas has been blown.

It is preferable that the distance D between the first flow-straightening plate 6 and the lower roll 202 be 200 mm or less. In the case where this distance D is 200 mm or less, since a down-flow gas containing a large amount of water is led to the furnace entrance after having reached the furnace bottom, it is possible to prevent a gas containing a large amount of water from mixing into a region in which low dew point control is needed (that is, a region of a high-temperature steel strip), which is advantageous for decreasing the dew point.

There is a risk of the lower roll 202 and the first flow-straightening plate 6 coming close to each other due to thermal expansion and coming into contact with each other. Therefore, a lower limit is set to the distance D between the lower roll 202 and the first flow-straightening plate 6. Since the maximum value of the sum of the diameter of the lower roll 202 and the height of the first flow-straightening plate 6 is 3 m, and since the highest temperature is 850° C., the amount of thermal expansion is 850° C.×3000 mm×$1.4E^{-5}$ (/° C.)=35.7 mm. Therefore, in the case where the distance D is 40 mm or more, there is no risk of the lower roll 202 and the first flow-straightening plate 6 coming into contact with each other. Therefore, it is preferable that the distance D between the lower roll 202 and the first flow-straightening plate 6 be 40 mm or more.

The second flow-straightening plate 7 and the third flow-straightening plate 8 are convex bodies extending from the side walls of the vertical annealing furnace 2 and facing each other at positions immediately before the position where the steel strip 5 is wound on the lower roll 202.

Figure 7:
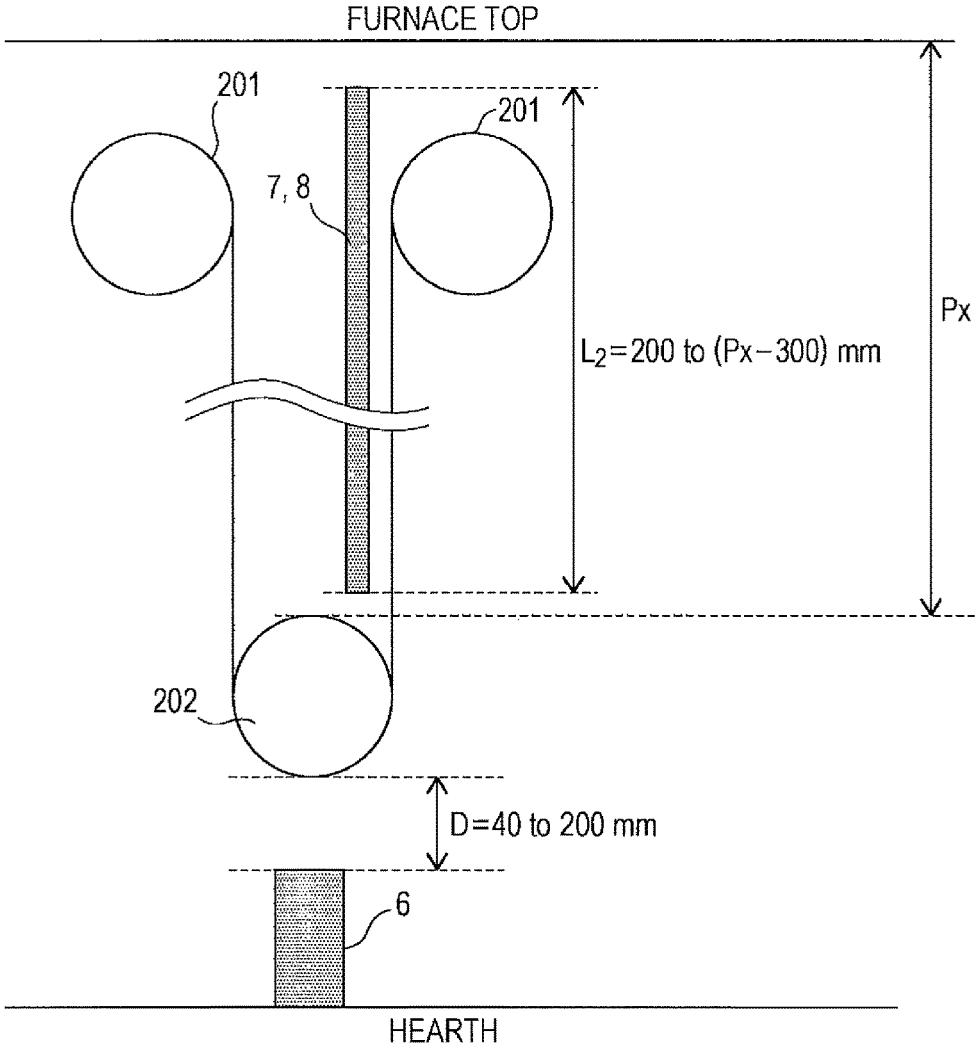
FIG. 7 is a schematic diagram used for describing dimensions of the first flow-straightening plate, the second flow-straightening plate and the third flow-straightening plate.

With reference to FIG. 3 and FIG. 7, the dimensions of the second flow-straightening plate and the third flow-straightening plate will be described. It is preferable that the second flow-straightening plate 7 and the third flow-straightening plate 8 have a length ($L_1$) of 200 mm or more in the width direction of the steel strip and a length ($L_2$) of 100 mm or more in the traveling direction of the steel strip. In the case where the length $L_1$ and the length $L_2$ are within the ranges described above, since a down-flow gas containing a large amount of water is led to the furnace entrance after having reached the furnace bottom, it is possible to prevent a gas containing a large amount of water from mixing into a region in which low dew point control is needed (that is, a region of a high-temperature steel strip), which is advantageous for decreasing the dew point.

In addition, regarding the second flow-straightening plate 7 and the third flow-straightening plate 8, an upper limit is set to the length ($L_1$) in the width direction of the steel strip and the length ($L_2$) in the traveling direction of the steel strip so that the second flow-straightening plate 7 and the third flow-straightening plate 8 maintain sufficient distance from the steel strip 5 in order to avoid coming into contact with the steel strip 5 in consideration of the meandering and thermal expansion of the steel strip 5.

When the width of the steel strip 5 is defined as Ws and the maximum value of the furnace width is 2400 mm, since the amount of thermal expansion in the width direction of the steel strip 5 and the second flow-straightening plate 7 (or the third flow-straightening plate 8) is 1200 mm×1.4E$^{-5}$(/° C.)×850° C.=14.3 mm (where 1200 mm=Ws/2+the length $L_1$ in the width direction of the flow-straightening plate), and since the amount of meandering is about 30 mm, the steel strip 5 and the second flow-straightening plate 7 (or the third flow-straightening plate 8) do not come into contact with each other in an ordinary case by maintaining a distance of 50 mm or more therebetween in the width direction.

Therefore, when the furnace width is defined as Wf, it is preferable that the second flow-straightening plate 7 and the third flow-straightening plate 8 have a length ($L_1$) of ((Wf−Ws)/2−50) mm or less in the width direction of the steel strip 5.

Here, Ws is the maximum value of the widths of steel grades for which low dew point is required but not of all steel grades. In the case of a steel strip which is not a target of dew point control, it is preferable that the second flow-straightening plates 7 and the third flow-straightening plates 8 be folded in order to avoid them coming into contact with the steel strip.

In addition, it is preferable that the second flow-straightening plate 7 and the third flow-straightening plate 8 have a length ($L_2$) of (Px−300) mm or less in the traveling direction of the steel strip 5. Here Px is the distance between the furnace top and the top surface of the lower roll 202.

Although, ideally, the second flow-straightening plate 7 and the third flow-straightening plate 8 cover the whole region between the furnace top and the lower roll 202, since there is a risk of contact due to thermal expansion as described above, an upper limit is also set to the length ($L_2$) in the traveling direction of the steel strip 5.

Since the distance Px between the furnace top and the top surface of the lower roll 202 is generally about 25 m, the amount of thermal expansion of the diameter of the lower roll 202 and the second flow-straightening plate 7 (or the third flow-straightening plate 8) is 25000 mm×1.4E$^{-5}$×850=286 mm. Therefore, in the case where there is a clearance of 300 mm, there is no risk of the furnace top and the second flow-straightening plate 7 (or the third flow-straightening plate 8) coming into contact with each other.

Therefore, it is preferable that the second flow-straightening plate 7 and the third flow-straightening plate 8 have a length ($L_2$) of (Px−300) mm or less in the traveling direction of the steel strip 5.

Here, the second flow-straightening plate 7 and the third flow-straightening plate 8 are placed so that it is possible to extend toward the furnace top as much as possible. This is because the gap between the roll and the second flow-straightening plate 7 and the third flow-straightening plate 8 is more important for atmosphere separation than the gap between the furnace top and the plates.

Here, although the dividing wall 22 is provided between the soaking zone 21 and the cooling zone 23 in the present embodiment, the disclosed embodiments may also be applied to a case where the dividing wall 22 is not provided.

EXAMPLES

Examples of the disclosed embodiments will be described.

Figure 4:
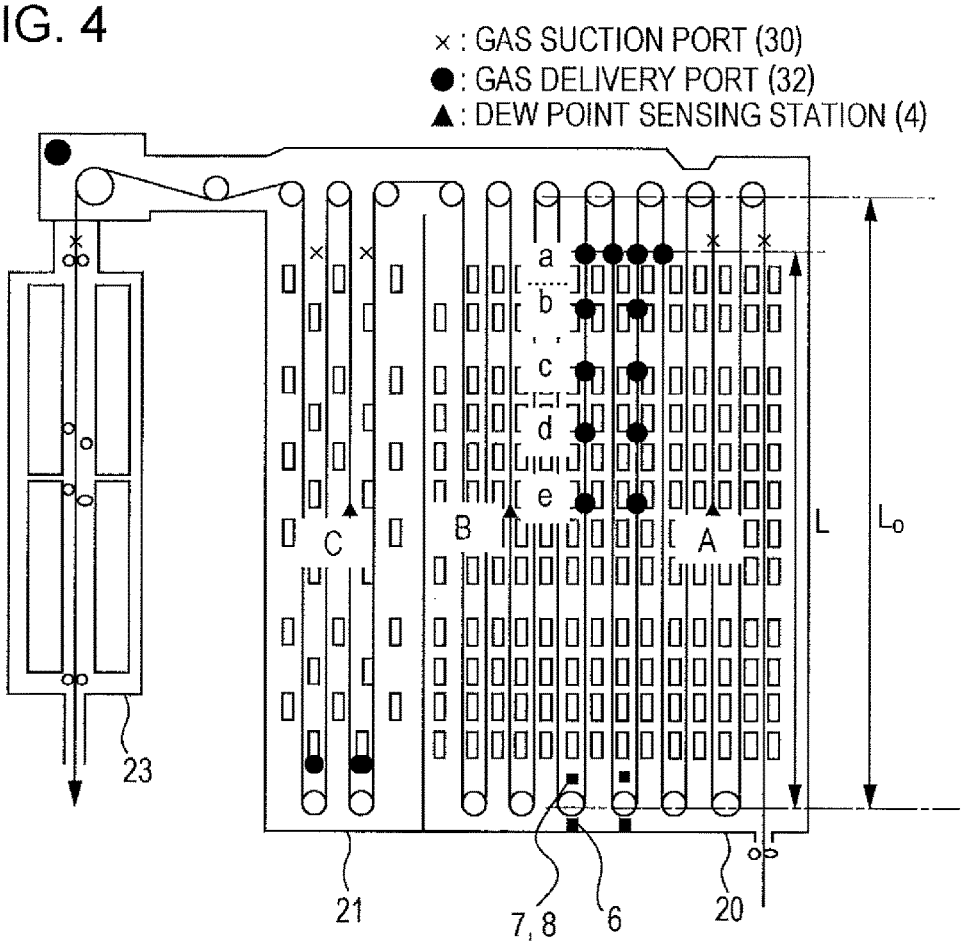
FIG. 4 is a schematic diagram illustrating the continuous annealing system used in Examples according to embodiments.
Figure 5:
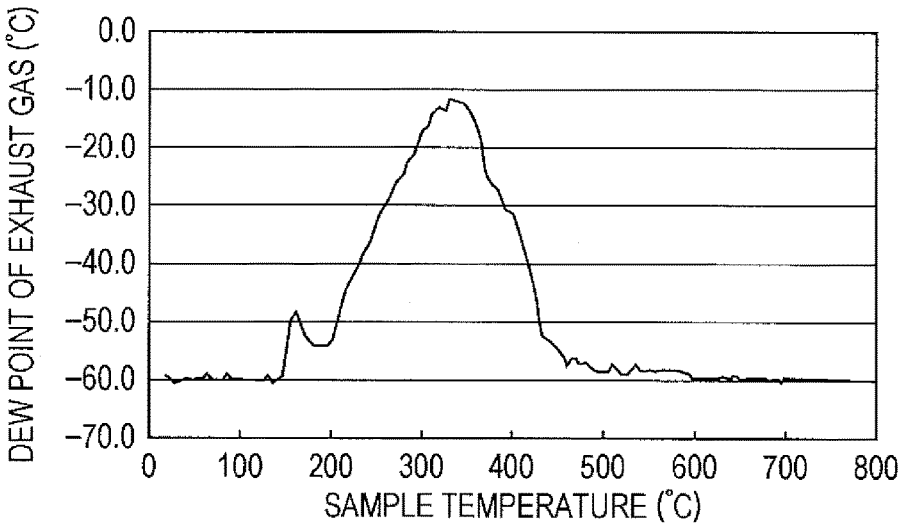
FIG. 5 is a diagram illustrating a temperature range in which water is desorbed.
Figure 6:
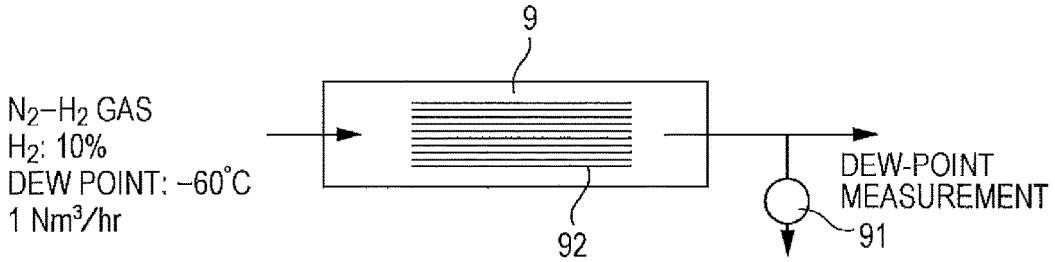
FIG. 6 is a diagram illustrating a method of experiments conducted in close investigations regarding a temperature range in which water is desorbed.

The continuous annealing system used in the examples of the disclosed embodiments is illustrated in FIG. 4. As illustrated in FIG. 4, this continuous annealing system fundamentally had a configuration similar to that of the continuous annealing system I illustrated in FIGS. 1 through 3.

That is, this continuous annealing system is a continuous annealing system including an ART type (All Radiant Tube type) annealing furnace, in which the dividing wall which physically separates the atmospheres inside the furnace was placed between the heating zone 20 and the soaking zone 21, with the refiner having the dehumidification device and the deoxidation device being placed outside of the furnace and with the gas delivery ports 32 being placed at 15 positions indicated by ● in FIG. 4.

Among the 15 delivery ports, ones placed at 12 positions located on the 5th through 8th passes in the heating zone 20 were directly related to the examples of the disclosed embodiments. The values of $L/L_0$ for the delivery ports placed at the 12 positions in the heating zone 20 were respectively 0.5, 0.6, 0.7, 0.8, and 0.9 in the 6th and 8th passes (descending passes) and 0.9 in the 5th and 7th passes (ascending passes). Moreover, in the case of delivery ports placed at the positions corresponding to an $L/L_0$ of 0.9 in the 6th and 8th passes, adjusting plates were fitted to the mouths of the gas delivery ports so that the angles of the delivered gases were adjusted. Here, the mouths of the other delivery ports blew the gases in the horizontal direction.

In addition, the difference between cases with the flow-straightening plates 6 through 8 being placed in the lower part of the heating zone and cases without a flow-straightening plate was also investigated. Here, the temperature of a steel strip was determined by using a multiple reflection type radiation thermometer, and the dew point was determined by using mirror surface type dew point meters at the centers of the respective regions (points A, B, and C indicated by ▲in FIG. 4).

The first flow-straightening plate 6 under the lower roll had a length of (the furnace width −50 mm=2350 mm) in the Y-direction, a length of 100 mm in the X-direction, and a length of 400 mm in the Z-direction (the distance D was 50 mm). Although, ideally, the length in the Y-direction was equal to the furnace width, the length in the Y-direction was decided in consideration of thermal expansion allowance. In addition, although it is preferable that the length in the Z-direction be decided so that the first flow-straightening plate is as near as possible to the lower surface of the lower roll, this length was also decided in consideration of thermal expansion and thermal deformation.

Conditions regarding the gas suction ports 30 were fixed for all examples other than one example without gas suction or gas delivery, and the position in the Z-direction was located at −0.5 m from the furnace top, the position in the X-direction was located at 1 m from the furnace wall, and the diameter of the gas suction mouth was 200 mmϕ. Here, the amount of gas suctioned through one gas suction port was 500 $Nm^3$/hr.

Here, the atmospheric gas is fed from the outside of the furnace, and the feeding ports of the atmospheric gas were placed at 18 positions in total on the side wall of the soaking zone, that is, 9 positions on each of the two lines in the longitudinal direction of the furnace (X-direction) which were located at a height (Z-direction) of 1 m and 10 m from the hearth. The fed atmospheric gas was an $H_2$—$N_2$ gas ($H_2$ concentration: 10 vol. %) having a dew point of −60° C. to −70° C.

By using cold-rolled steel strips having a thickness of 0.8 mm to 1.2 mm and a width of 950 mm to 1000 mm, the conditions were controlled to be as constant as possible so that the annealing temperature was 820° C. and the traveling speed was 100 mpm to 120 mpm.

Here, the chemical composition of the cold-rolled steel strip contained the constituent chemical elements given in Table 1 and the balance being Fe and inevitable impurities.

TABLE 1

| C | Si | Mn | S | (mass %) Al |
|---|---|---|---|---|
| 0.12 | 0.5 | 1.7 | 0.003 | 0.03 |

By annealing the steel strips under the conditions described above and given in Table 2, and by then performing a galvanization treatment on the steel strips, zinc coatability was evaluated by performing a visual test (Nos. 1 through 16). A case where a nonplating defect was not found in the testing region (width×length of 2.0 m) was judged as ⊙, a case where one minor nonplating defect (having a diameter of less than 0.2 mmϕ) was found was judged as ○, a case where the number of minor nonplating defects found was less than 5 was judged as Δ, and the other cases (where the number of nonplating defects having a diameter of less than 0.2 mϕ found was 5 or more or a nonplating defect having a diameter of 0.2 mmϕ or more was found) were judged as ×.

The results are also given in Table 2.

As indicated in Table 2, it is clarified that the examples of Nos. 2 and 5 according to the disclosed embodiments showed satisfactory zinc coatability (⊙) with excellent aesthetic appearance, the other examples of the disclosed embodiments (Nos. 3 to 10 and 14 to 16) achieved a satisfactory level of quality (○) to be used for an inner plate with only one minor nonplating defect.

In contrast, in the case of the comparative examples (Nos. 1 and 11 to 13), which did not satisfy the conditions of the disclosed embodiments, zinc coatability was poor (Δ or ×).

Here, the reason why No. 13 (comparative example) and No. 15 (example of the disclosed embodiments) were inferior to No. 2 (example of the disclosed embodiments) in terms of zinc coatability even though they had dew points almost equal to that of No. 2 is considered to be because, since their temperature was high (in particular, higher than 700° C. in the case of No. 13) on the 8th pass, surface concentration had already progressed in the former part of the heating zone.

TABLE 2

| | Delivery Condition (5th Pass) | | Delivery Condition (6th Pass) | | | Delivery Condition (7th Pass) | | Delivery Condition (8th Pass) | | | with or without | Dew Point | | | Zinc | |
|---|---|---|---|---|---|---|---|---|---|---|---|---|---|---|---|---|
| No. | Flow Rate $Nm^3$/hr | Passing Temperature ° C. | Flow Rate $Nm^3$/hr | Passing Temperature ° C. | Angle* ° | Flow Rate $Nm^3$/hr | Passing Temperature ° C. | Flow Rate $Nm^3$/hr | Passing Temperature ° C. | Angle* ° | Straightener | A ° C. | B ° C. | C ° C. | Coatability | Note |
| 1 | 0 | 332 | 0 | 391 | — | 0 | 491 | 0 | 573 | — | without | −35.2 | −35.9 | −36.6 | X | Comparative Example |
| 2 | 0 | 332 | 600 | 391 | −10 | 0 | 491 | 600 | 573 | −10 | with | −36.7 | −51.2 | −51.6 | ⊙ | Example |
| 3 | 0 | 332 | 1200 | 391 | −10 | 0 | 491 | 0 | 573 | — | with | −37.9 | −47.8 | −48.3 | ○ | Example |
| 4 | 0 | 332 | 0 | 391 | — | 0 | 491 | 1200 | 573 | −10 | with | −37.3 | −48.3 | −48.3 | ○ | Example |
| 5 | 0 | 332 | 600 | 391 | −20 | 0 | 491 | 600 | 573 | −20 | with | −36.5 | −50.6 | −50.8 | ⊙ | Example |
| 6 | 0 | 332 | 600 | 391 | −30 | 0 | 491 | 600 | 573 | −30 | with | −36.7 | −47.9 | −48.3 | ○ | Example |
| 7 | 0 | 332 | 600 | 391 | −40 | 0 | 491 | 600 | 573 | −40 | with | −37.3 | −42.1 | −45.0 | ○ | Example |
| 8 | 0 | 332 | 600 | 391 | 0 | 0 | 491 | 600 | 573 | 0 | with | −36.8 | −49.2 | −50.2 | ○ | Example |
| 9 | 0 | 332 | 600 | 391 | 10 | 0 | 491 | 600 | 573 | 10 | with | −36.5 | −46.5 | −47.3 | ○ | Example |
| 10 | 0 | 332 | 600 | 391 | 20 | 0 | 491 | 600 | 573 | 20 | with | −36.4 | −44.3 | −45.9 | ○ | Example |
| 11 | 600 | 332 | 0 | 391 | — | 600 | 491 | 0 | 573 | — | with | −40.3 | −41.8 | −42.2 | X | Comparative Example |
| 12 | 0 | 231 | 600 | 271 | −10 | 0 | 355 | 600 | 428 | −10 | with | −44.0 | −36.9 | −41.5 | X | Comparative Example |

TABLE 2-continued

| No. | Delivery Condition (5th Pass) Flow Rate Nm³/hr | Delivery Condition (5th Pass) Passing Temperature ° C. | Delivery Condition (6th Pass) Flow Rate Nm³/hr | Delivery Condition (6th Pass) Passing Temperature ° C. | Delivery Condition (6th Pass) Angle* ° | Delivery Condition (7th Pass) Flow Rate Nm³/hr | Delivery Condition (7th Pass) Passing Temperature ° C. | Delivery Condition (8th Pass) Flow Rate Nm³/hr | Delivery Condition (8th Pass) Passing Temperature ° C. | Delivery Condition (8th Pass) Angle* ° | with or without Flow Straightener | Dew Point A ° C. | Dew Point B ° C. | Dew Point C ° C. | Zinc Coatability | Note |
|---|---|---|---|---|---|---|---|---|---|---|---|---|---|---|---|---|
| 13 | 0 | 491 | 600 | 566 | −10 | 0 | 670 | 600 | 735 | −10 | with | −35.1 | −51.3 | −51.1 | Δ | Comparative Example |
| 14 | 0 | 266 | 600 | 313 | −10 | 0 | 426 | 600 | 517 | −10 | with | −40.1 | −47.3 | −50.8 | ○ | Example |
| 15 | 0 | 412 | 600 | 479 | −10 | 0 | 599 | 600 | 685 | −10 | with | −35.7 | −51.0 | −51.3 | ○ | Example |
| 16 | 0 | 332 | 600 | 391 | −10 | 0 | 491 | 600 | 573 | −10 | without | −36.9 | −47.8 | −49.0 | ○ | Example |

Delivery port position: L/L0 = 0.9 in all cases
*Delivery angle: +; upward, −; downward Moreover, by performing the similar annealing and galvanizing treatment described above with various values of $L/L_0$ under conditions based on the condition for No. 2, and by evaluating zinc coatability by performing a visual test, the optimum height of gas delivery ports was determined.

That is, the case of $L/L_0$=0.9 (height indicated by a in FIG. 4), which was the condition of No. 2, was defined as No. 2a, and the case of $L/L_0$=0.8 (height indicated by b in FIG. 4), the case of $L/L_0$=0.7 (height indicated by c in FIG. 4), the case of $L/L_0$=0.6 (height indicated by d in FIG. 4), and the case of $L/L_0$=0.5 (height indicated by e in FIG. 4) were respectively defined as No. 2b, No. 2c, No. 2d, and No. 2e.

The results are given in Table 3.

As indicated in Table 3, it is clarified that, in the cases (No. 2a, No. 2b, and No. 2c) where the gas delivery port was placed at a height which satisfied the relationship $L/L_0 \geq 0.7$, it is possible to achieve good zinc coatability (⊙).

TABLE 3

| No. | L/L0 | Delivery Condition (6th Pass) Flow Rate Nm³/hr | Delivery Condition (6th Pass) Passing Temperature ° C. | Delivery Condition (6th Pass) Angle* ° | Delivery Condition (8th Pass) Flow Rate Nm³/hr | Delivery Condition (8th Pass) Passing Temperature ° C. | Delivery Condition (8th Pass) Angle* ° | with or without Flow Straightener | Dew Point A ° C. | Dew Point B ° C. | Dew Point C ° C. | Zinc Coatability | Note |
|---|---|---|---|---|---|---|---|---|---|---|---|---|---|
| 2a | 0.9 | 600 | 391 | −10 | 600 | 573 | −10 | with | −36.7 | −51.2 | −51.6 | ⊙ | Example |
| 2b | 0.8 | 600 | 391 | 0 | 600 | 573 | 0 | with | −37.0 | −51.1 | −51.6 | ⊙ | Example |
| 2c | 0.7 | 600 | 391 | 0 | 600 | 573 | 0 | with | −36.8 | −47.7 | −48.6 | ⊙ | Example |
| 2d | 0.6 | 600 | 391 | 0 | 600 | 573 | 0 | with | −36.6 | −45.1 | −45.9 | ○ | Example |
| 2e | 0.5 | 600 | 391 | 0 | 600 | 573 | 0 | with | −36.8 | −44.1 | −44.6 | ○ | Example |

*Delivery angle: +; upward, −; downward

REFERENCE SIGNS LIST

1 continuous annealing system
2 vertical annealing furnace
20 heating zone
  200 open mouth
  201 upper roll
  202 lower roll
21 soaking zone
  210 upper roll
  211 lower roll
22 dividing wall
23 cooling zone
  230 guide roll
24 connecting section
  240 roll
  241 throat
  242 seal roll
3 oxygen-water-removing unit
30 gas suction port
31 refiner
32 gas delivery port
4 dew point sensing station
5 steel strip
6 first flow-straightening plate
7 second flow-straightening plate
8 third flow-straightening plate
9 infrared heating furnace
91 mirror surface type dew point meter
92 steel sheet

The invention claimed is:

1. A continuous annealing system comprising:

a vertical annealing furnace comprising upper rolls, lower rolls, a heating zone, and a soaking zone, the upper rolls and lower rolls configured to wind a steel strip;

gas suction ports configured to suction a part of a gas inside the vertical annealing furnace, at least one gas suction port of the gas suction ports being disposed in the heating zone;

a refiner configured to remove water and oxygen from the gas suctioned through the gas suction ports; and gas delivery ports configured to return the gas treated in the refiner to the vertical annealing furnace and to blow the gas to the steel strip, wherein the gas delivery ports are provided at positions where (i) the gas is blown to a portion of the steel strip that is descending in the vertical annealing furnace and (ii) the portion of the steel strip is at a temperature in the range of 300° C. to 700 ° C.

2. The continuous annealing system according to claim 1, wherein one or more of the gas delivery ports are placed at a position in the vertical annealing furnace expressed by the relational expression:

$$L \geq 0.7 \times L_0,$$

where L is distance from the center of a lower roll to a delivery port and $L_0$ is distance between the centers of an upper roll and a lower roll on which the steel strip travels next to the upper roll.

3. The continuous annealing system according to claim 1, wherein one or more of the gas delivery ports are placed on a side wall of the vertical annealing furnace so that the gas from the one or more of the gas delivery ports is blown in a direction at an angle in the range of −30° to +10°where + indicates an upward direction and − indicates a downward direction to a horizontal direction of the vertical annealing furnace.

4. The continuous annealing system according to claim 1, wherein the gas is blown in a direction from a same side wall of the vertical annealing furnace through all of the gas delivery ports.

5. The continuous annealing system according to claim 1, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

6. A continuous annealing method for continuously annealing a steel strip by using a vertical annealing furnace comprising upper rolls and lower rolls on which a steel strip is wound, a heating zone, and a soaking zone, the method comprising:

suctioning with gas suction ports a part of a gas inside the vertical annealing furnace, at least one gas suction port of the gas suction ports being disposed in the heating zone;

removing with a refiner water and oxygen from the gas suctioned through the gas suction ports; and returning via gas delivery ports the gas treated in the refiner to the vertical annealing furnace and blowing the gas to the steel strip, wherein the gas delivery ports are provided at positions where (i) the gas is blown to a portion of the steel strip that is descending in the vertical annealing furnace and (ii) the portion of the steel strip is at a temperature in the range of 300° C. to 700° C.

7. The continuous annealing method according to claim 6, wherein one or more of the gas delivery ports are placed at a position expressed by the relational expression:

$$L \geq 0.7 \times L_0,$$

where L is distance from the center of a lower roll to a delivery port and $L_0$ is distance between the centers of an upper roll and a lower roll on which the steel strip travels next to the upper roll.

8. The continuous annealing method according to claim 6, wherein one or more of the gas delivery ports are placed on a side wall of the vertical annealing furnace so that gas from the one or more of the gas delivery ports is blown in a direction at an angle in the range of −30° to +10°, where + indicates an upward direction and − indicates a downward direction to a horizontal direction of the vertical annealing furnace.

9. The continuous annealing method according to claim 6, wherein the gas is blown in a direction from a same side wall of the vertical annealing furnace through all of the gas delivery ports.

10. The continuous annealing method according to claim 6, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

11. The continuous annealing system according to claim 2, wherein one or more of the gas delivery ports are placed on a side wall of the vertical annealing furnace so that the gas from the one or more of the gas delivery ports is blown in a direction at an angle in the range of −30° to +10°, where + indicates an upward direction and − indicates a downward direction to a horizontal direction of the vertical annealing furnace.

12. The continuous annealing system according to claim 2, wherein the gas is blown in a direction from a same side wall of the vertical annealing furnace through all of the gas delivery ports.

13. The continuous annealing system according to claim 3, wherein the gas is blown in a direction from a same side wall of the vertical annealing furnace through all of the gas delivery ports.

14. The continuous annealing system according to claim 2, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

15. The continuous annealing system according to claim 3, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

16. The continuous annealing system according to claim 4, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

17. The continuous annealing method according to claim 7, wherein one or more of the gas delivery ports are placed on a side wall of the vertical annealing furnace so that gas from the one or more of the gas delivery ports is blown in a direction at an angle in the range of −30° to +10°, where + indicates an upward direction and − indicates a downward direction to a horizontal direction of the vertical annealing furnace.

18. The continuous annealing method according to claim 7, wherein the gas is blown in a direction from a same side wall of the vertical annealing furnace through all of the gas delivery ports.

19. The continuous annealing method according to claim 8, wherein the gas is blown in a direction from a same side wall of the vertical annealing furnace through all of the gas delivery ports.

20. The continuous annealing method according to claim 7, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

21. The continuous annealing method according to claim 8, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

22. The continuous annealing method according to claim 9, wherein the vertical annealing furnace further comprises a first flow-straightening plate, a second flow-straightening plate, and a third flow-straightening plate, the first flow-straightening plate is a convex body extending from a bottom of the vertical annealing furnace and faces the lower roll on which a part of the steel strip is wound first in a direction in which the gas is blown from one of the gas delivery ports, or in a vicinity of the direction, after the gas has been blown, the second flow-straightening plate and the third flow-straightening plate are convex bodies extending from side walls of the vertical annealing furnace and face each other at positions immediately before a position where the part of the steel strip is wound on the lower roll, the distance between the lower roll and the first flow-straightening plate is in the range of 40 mm to 200 mm, and the second flow-straightening plate and the third flow-straightening plate have a length in the range of 200 mm to ((Wf−Ws)/2−50) mm in a width direction of the steel strip and a length of 100 mm to (Px−300) mm in a traveling direction of the steel strip, where Wf is furnace width, Ws is width of the steel strip, and Px is distance between a top of the furnace and a top surface of the lower roll.

* * * * *